United States Patent [19]

Mott

[11] 4,142,341

[45] Mar. 6, 1979

[54] PANEL CONSTRUCTION FOR ELEVATED FLOOR SYSTEMS

[75] Inventor: George C. Mott, Redford, Mich.

[73] Assignee: Mult-A-Frame Corporation, Pontiac, Mich.

[21] Appl. No.: 869,632

[22] Filed: Jan. 16, 1978

[51] Int. Cl.[2] ..... E04F 15/024

[52] U.S. Cl. ..... 52/263; 52/803

[58] Field of Search ..... 52/179, 180, 177, 263, 52/127, 173, 623, 619, 126, 783, 803

[56] References Cited

U.S. PATENT DOCUMENTS

| | | | |
|---|---|---|---|
| 2,881,485 | 4/1959 | Hyman | 52/627 |
| 3,396,501 | 8/1968 | Tate | 52/619 |

FOREIGN PATENT DOCUMENTS

| | | | |
|---|---|---|---|
| 662878 | 5/1963 | Canada | 52/179 |
| 1352676 | 1/1964 | France | 55/490 |

*Primary Examiner*—James L. Ridgill, Jr.

*Attorney, Agent, or Firm*—Harness, Dickey & Pierce

[57] ABSTRACT

A construction for insuring that the edges of panels used in elevated floor systems do not become loose with handling. The construction comprises serrated surfaces on the tops and bottoms of the panel flanges, which interfit with corresponding complementary serrations on the inner facing surfaces of the channel edge strip. The serrations on the flange also extend under the outer portion of the wear surface covering layer to inhibit loosening.

3 Claims, 2 Drawing Figures

PANEL CONSTRUCTION FOR ELEVATED FLOOR SYSTEMS

BACKGROUND OF THE INVENTION

1. Field of the Invention

The invention relates to access floor systems of the modular type which are used elevated to provide space for conduits or cables such as are used for computers or other electronic equipment. The invention is concerned with the panel construction for such floor systems and in particular with the edge construction of such panels.

2. Description of the Prior Art

Tate U.S. Pat. No. 3,396,501 shows an example of a panel construction in such systems wherein a flat upper metal load receiving panel and a lower steel panel have their marginal edges in close contact to form a peripheral flange on the panel. Channel shaped edge strips are slipped over these margins, and a wear surface covering layer on the upper steel panel is flush with the upper flange of the edge strip. In order to secure the edge strip to the panel flange, it is known to utilize cement, as described in the aforementioned patent. It is also known to form longitudinal serrations on the inside flange surfaces of the channel shaped edge strip in an attempt to grip the composite marginal panel flange on both top and bottom.

However, these prior methods and constructions for securing the edge strip in position have been found to be less than satisfactory. In use, access floor panels are periodically removed and replaced in order to service the equipment underneath. This often involves strong impacts on the edge strips, especially when the panels are being replaced at which time they may be kicked or struck by a tool. The result is a pervasive problem of edge strip loosening or peeling off. Once the edges become deformed, loose or removed, the panel is subject to water damage especially if water leaks underneath the outer margins of the wear surface covering layer, which then in turn could become partially or completely dislodged.

A solution which has been proposed for this problem is to place an extra part on the outside of the panel which surrounds the edge strip to hold it in place. This however is an expensive construction and it is difficult to maintain proper dimensional control which is needed for installation.

Another difficulty resulting from loose or missing edge strips is that it becomes difficult to properly install a long series of panels. Proper installation requires that the panel fit very closely to prevent "growing" in long stretches; otherwise, difficulty will be encountered when trying to fit the panels between two opposite walls in a large room.

BRIEF SUMMARY OF THE INVENTION

It is an object of the present invention to provide a novel and improved access floor panel construction which overcomes the above described difficulties and insures proper and permanent retention of the edge strips on the marginal flange, despite repeated impacts during handling of the panel.

It is another object to provide an improved access floor panel construction of this nature which also inhibits loosening or curling of the margins on the wear surface covering layer.

It is a further object to provide an improved construction of this character which is very inexpensive to fabricate and is compatible with existing edge strip constructions.

Briefly, the invention comprises the combination, with an access floor panel of the type having a marginal panel flange and a channel shaped edge strip mounted on said flange, of interfitting longitudinal serrations on the opposite inwardly facing surfaces of the edge strip and the outwardly facing upper and lower surfaces of the marginal panel flange, said interfitting serrations being such that longitudinal inward projections on said edge strip will be received by longitudinal outwardly facing complementary recesses on said marginal panel flange.

DESCRIPTION OF THE PREFERRED EMBODIMENT

Figure 1:
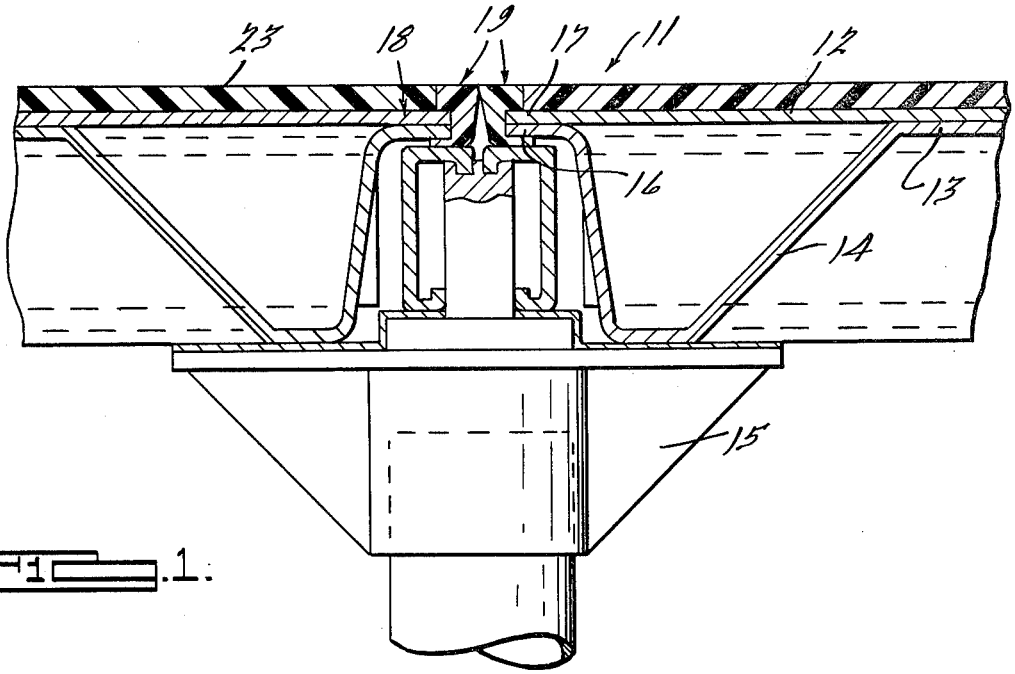
FIG. 1 is a cross-sectional view of a portion of an access floor panel constructed according to the present invention.
Figure 2:
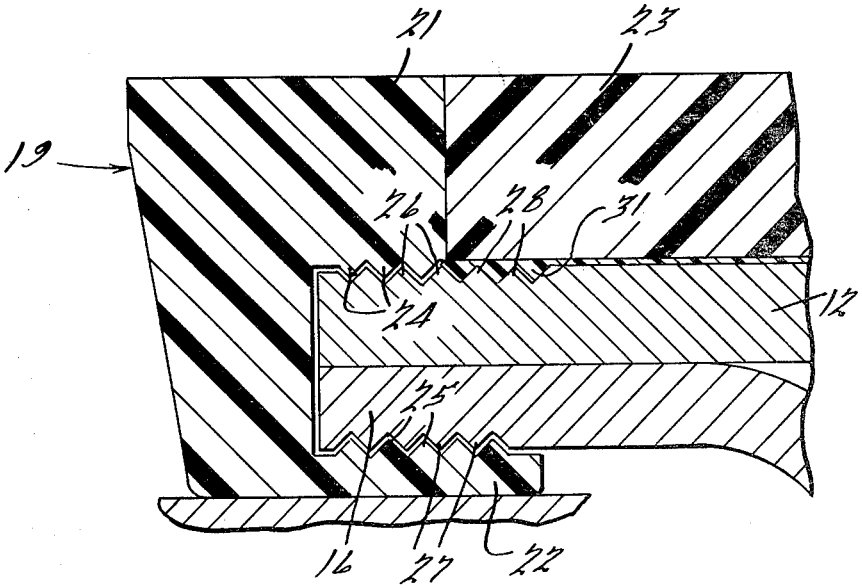
FIG. 2 is an enlarged fragmentary view showing the gripping construction of the invention.

A portion of an access floor panel is shown in FIG. 1 and generally indicated at 11. The square panel comprises an upper flat steel load receiving plate 12 and a lower steel plate 13 having peripheral bent portions 14 resting on pedestals 15, and marginal portions 16 which overlap the marginal portions 17 of plate 12. These two marginal portions together form a composite marginal panel flange generally indicated at 18.

An edge strip generally indicated at 19 is mounted on composite flange 18. This strip may be fabricated of a vinyl or other extruded plastic material and has an upper flange 21 and a lower flange 22. A wear surface covering layer 23 is mounted on load receiving plate 12 and its upper surface is flush with the upper surface of edge strip flange 21.

A plurality of longitudinal serrations 24 and 25 are formed on the insides of the upper and lower flanges 21 and 22 respectively of edge strip 19. These serrations may be formed during the extruding operation which fabricates the edge strip. Preferably these serrations are of sufficient depth and spacing to carry out the objects of the invention as above described. A plurality of complementary serrations 26 and 27 are formed on the upper and lower surfaces of composite marginal panel flange 18. The positioning and configuration of the serrations on both edge strip 19 and composite flange 18 are such that when edge 19 is fully slipped over flange 18 the serrations will closely interfit with each other. The result will be that edge strip 19 will tightly grip flange 18 to prevent dislodgement even after repeated handling and impact forces.

Additional serrations 28 are provided on upper surface 29 of plate 12. These will receive adhesive 31 which is used to secure wear surface covering layer 23 to plate 12, enhancing the ability of the adhesive to retain the margins of layer 23 in position.

Serrations 26, 27 and 28 may be formed by any appropriate method. A suitable way of forming these serrations is by rolling, for example rolling both the upper and lower serrations on opposite sides of the panel at one time, then turning the panel 90° and roll forming the other two sides.

While it will be apparent that the preferred embodiment of the invention disclosed is well calculated to fulfill the object above stated, it will be appreciated that the invention is susceptible to modification, variation and change without departing from the proper scope or fair meaning of the subjoined claims.

I claim:

1. The combination, with an access floor panel of the type having a rigid marginal panel flange, and a channel shaped edge strip mounted on said flange, of interfitting rigid longitudinal serrations on the opposite inwardly facing surfaces of the edge strip and the outwardly facing upper and lower surfaces of the rigid marginal panel flange, said interfitting serrations being such that longitudinal inward projections on said edge strip will be received by longitudinal outwardly facing complementary recesses on said marginal panel flange.

2. The combination according to claim 1, said marginal panel flange comprising a composite flange made up of the margins of an upper load receiving panel and a lower panel.

3. The combination according to claim 2, said access floor panel further comprising a wear surface covering layer, the upper serrations on said marginal panel flange also being present under the outer margins of said wear surface covering layer, and adhesive filling the interstices of said last mentioned serrations and thereby securing the margins of said wear surface covering layer in place.

* * * * *